US006127775A

United States Patent [19]

Bergen

[11] Patent Number: 6,127,775

[45] Date of Patent: Oct. 3, 2000

[54] IONIC DISPLAY WITH GRID FOCUSING

[75] Inventor: Richard F. Bergen, Ontario, N.Y.

[73] Assignee: Xerox Corporation, Stamford, Conn.

[21] Appl. No.: 09/106,161

[22] Filed: Jun. 29, 1998

[51] Int. Cl.[7] ..... H01J 29/70; H01J 1/62

[52] U.S. Cl. ..... 313/422; 313/495; 313/431; 346/159; 347/123

[58] Field of Search ..... 313/422, 308, 313/494, 495, 496, 497, 431

[56] References Cited

U.S. PATENT DOCUMENTS

| | | | |
|---|---|---|---|
| 3,594,610 | 7/1971 | Evans et al. | 315/169 |
| 4,129,779 | 12/1978 | Kingsley et al. | 250/315 |
| 4,963,738 | 10/1990 | Gundlach et al. | 250/326 |
| 5,257,045 | 10/1993 | Bergen et al. | 346/159 |
| 5,450,115 | 9/1995 | Bergen et al. | 347/123 |
| 5,583,393 | 12/1996 | Jones | 313/495 |
| 5,617,129 | 4/1997 | Chizuk, Jr. et al. | 347/123 |
| 5,655,184 | 8/1997 | Bergen | 399/135 |
| 5,841,457 | 11/1998 | Bergen | 347/120 |
| 5,861,712 | 6/1999 | Beetson et al. | 313/442 |
| 5,917,277 | 6/1999 | Knox et al. | 313/495 |
| 5,990,609 | 11/1999 | Knox et al. | 313/442 |
| 6,002,204 | 12/1999 | Beeteson et al. | 313/495 |

*Primary Examiner*—Nimeshkumar D. Patel
*Assistant Examiner*—Matthew J. Gerike
*Attorney, Agent, or Firm*—R. Hutter

[57] ABSTRACT

An electronic display device includes a two-dimensional array of point charge sources, which are aligned with a plurality of apertures defined in a substrate. Associated with each aperture is a set of electrodes, including a focusing electrode, which in effect funnels the ions from the charge source into a narrow stream, and a plurality of displacing electrodes, through which the ion stream can be caused to scan over a small two-dimensional area on a phosphor. Modulating the bias on the focusing electrode can be used to control the ion stream passing through an individual aperture according to image data. The combined action of a two-dimensional array of charge sources and associated control devices can create a single composite image on the phosphor.

43 Claims, 5 Drawing Sheets

FIG. 7
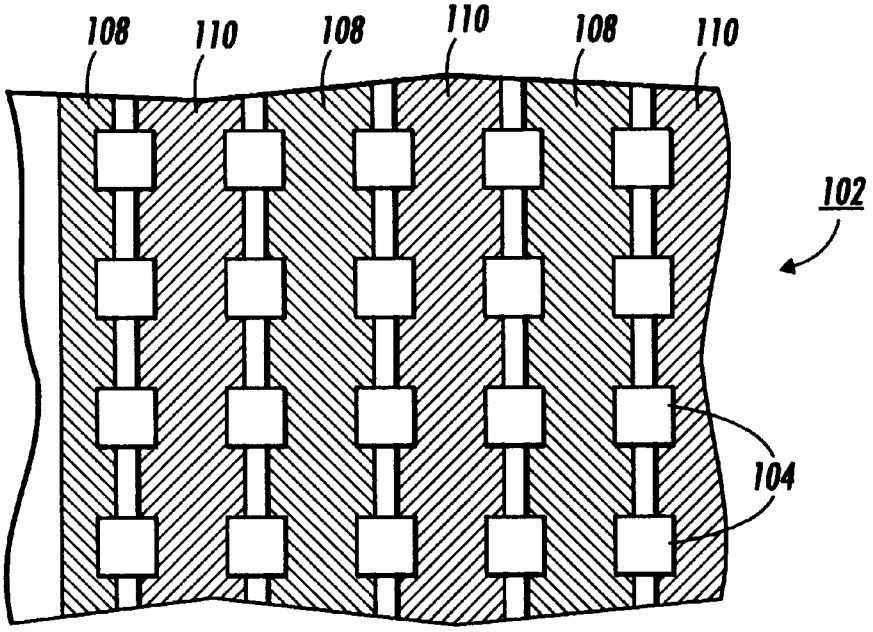
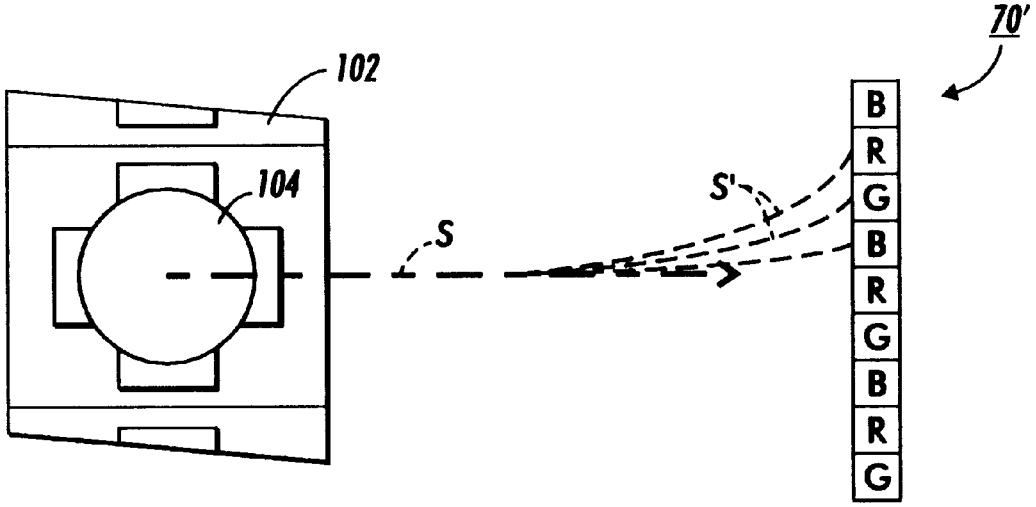
FIG. 8

IONIC DISPLAY WITH GRID FOCUSING

INCORPORATION BY REFERENCE

This application incorporates by reference U.S. Pat. No. 5,257,045 and U.S. Pat. No. 5,617,129, assigned to the assignee hereof.

FIELD OF THE INVENTION

The present invention relates to an electronic display device wherein ion streams from an array of controllable ion generators are directed to a phosphor.

BACKGROUND OF THE INVENTION

In electrostatographic printing, an electrostatic latent image is formed on a charge retentive surface. One type of electrostatographic printing is known as ionography. In ionography, a charge-retentive surface is charged in an imagewise fashion by the direct application of ions onto the charge retentive surface, known as a charge receptor. This latent image is developed by causing toner particles to adhere to the charged areas on the surface. The toner forming this developed image on the surface is then transferred to a sheet, such as of paper, and then the toner is fused on the sheet to form a permanent image.

U.S. Pat. No. 5,257,045 describes a particular kind of ionography which utilizes a "focused ion stream." In this type of ionography, a continuous stream of ions are emitted from an ion source, such as a corona wire, and are made available to a charge receptor on which a latent image is to be created. Disposed between the ion source and the charge receptor is an ion deposition control device, which is preferably in the form of a substrate interposed between the ion source and the charge receptor. The control device includes a plurality of apertures therein, through which ions can be selectively admitted from the ion source to selected positions on the charge receptor. Each of the apertures in the row has associated therewith a "pinch electrode" and one or more "displacing" electrodes. The purpose of the pinch electrode is to isolate a stream of ions from the radiations of ions which are generally being broadcast from the ion source and, in effect, to "funnel" the ion stream down to a much smaller predetermined cross-sectional width. By focusing the ion stream to a predetermined width, the ion stream can be directed to a suitably small spot size on the charge receptor, which in turn enables the creation of high-resolution latent images on the charge receptor. Displacing electrodes are used to direct this narrow beam of ions to the desired location on the charge receptor, so that a desired small area on the charge receptor may be charged according to its location in a desired image to be printed. The practical advantage of ionography with an ion stream is that the apertures can be made relatively large compared to the possible spot size of charged areas on the charge receptor, and therefore the ion deposition control device can be made quite cheaply.

The present invention exploits the principle of a "focused ion stream" known in electrophotographic printing and applies it to an electronic display.

DESCRIPTION OF THE PRIOR ART

U.S. Pat. No. 3,594,610 discloses an electroluminescent display panel in which intersecting rows and columns of conductors form a matrix. When a particular pair of conductors are addressed, a corona discharge is caused at their intersection. The corona discharge is used to excite an electroluminescent material.

U.S. Pat. No. 4,129,779 discloses a photocontrolled ion-flow electron radiography apparatus. A conductive substrate having an array of apertures therein is disposed between a planar ion source and an electrode which includes a film of an insulating material. The substrate includes a phosphor layer. An object to be x-rayed is interposed between a light source and the film, and the light passing through the object creates a charge image on the substrate. The planar ion source is then used to transfer a charge image created in the phosphor to the film, by passing ions through the apertures.

U.S. Pat. No. 4,963,738 describes a charging device having a coronode that includes a comb-like ruthenium glass electrode silk-screened onto a supporting dielectric substrate. This design of a charge source is useful for one embodiment of the present invention, as will be described below.

U.S. Pat. No. 5,257,045, incorporated by reference above, discloses the basic principle of using a pinch electrode and displacing electrodes to focus a stream of ions from an ion source, in the context of ionographic printing. U.S. Pat. Nos. 5,450,115 and 5,617,129 disclose improvements for a practical version of an ionographic printer such as basically described in the '045 patent.

U.S. Pat. No. 5,583,393 discloses various designs for a field emitter device for emitting electron or ion beams. A substrate has an array of field emitter elements thereon, in which the field emitter elements have a varied conformation to produce a beam of appropriate focused or directional character. The ion or electron streams from the device can be used with an array of phosphor elements to create a flat panel display.

SUMMARY OF THE INVENTION

According to one aspect of the present invention, there is provided an electronic display apparatus, comprising an ion source, a phosphor, and a first substrate, disposed between and spaced from the ion source and the charge receptor. The first substrate defines an aperture for passage of ions therethrough. A pinch electrode is disposed on the substrate and includes a conductive surface facing the ion source. A first displacing electrode is associated with the substrate, for displacing an ion stream passing through the aperture through a first displacement path.

According to another aspect of the present invention, there is provided an electronic display apparatus, comprising an ion source, a phosphor, and a first substrate disposed between and spaced from the ion source and the charge receptor. The first substrate defines an array of apertures for passage of ions therethrough. A pinch electrode is disposed on the substrate, including a conductive surface facing the ion source. A first displacing electrode is associated with each aperture in the substrate, for displacing an ion stream passing through the aperture through a first displacement path.

According to another aspect of the present invention, there is provided an electronic display apparatus, comprising a plurality of ion sources, arranged in an array, and a phosphor. A first substrate, disposed between and spaced from the ion source and the phosphor, defines an array of apertures, each aperture in the substrate aligned with an ion source. A focusing electrode is associated with each aperture, each focusing electrode including a conductive surface facing the source.

BRIEF DESCRIPTION OF THE DRAWINGS

FIG. 7 is a plan view of a substrate as used in the present invention, showing a preferred configuration of electrodes on a surface thereof; and FIG. 8 is a simplified perspective view of the essential elements of an embodiment of the present invention, wherein ion streams are directed to a phosphor for creating color images.

DETAILED DESCRIPTION OF THE INVENTION

Figure 1:
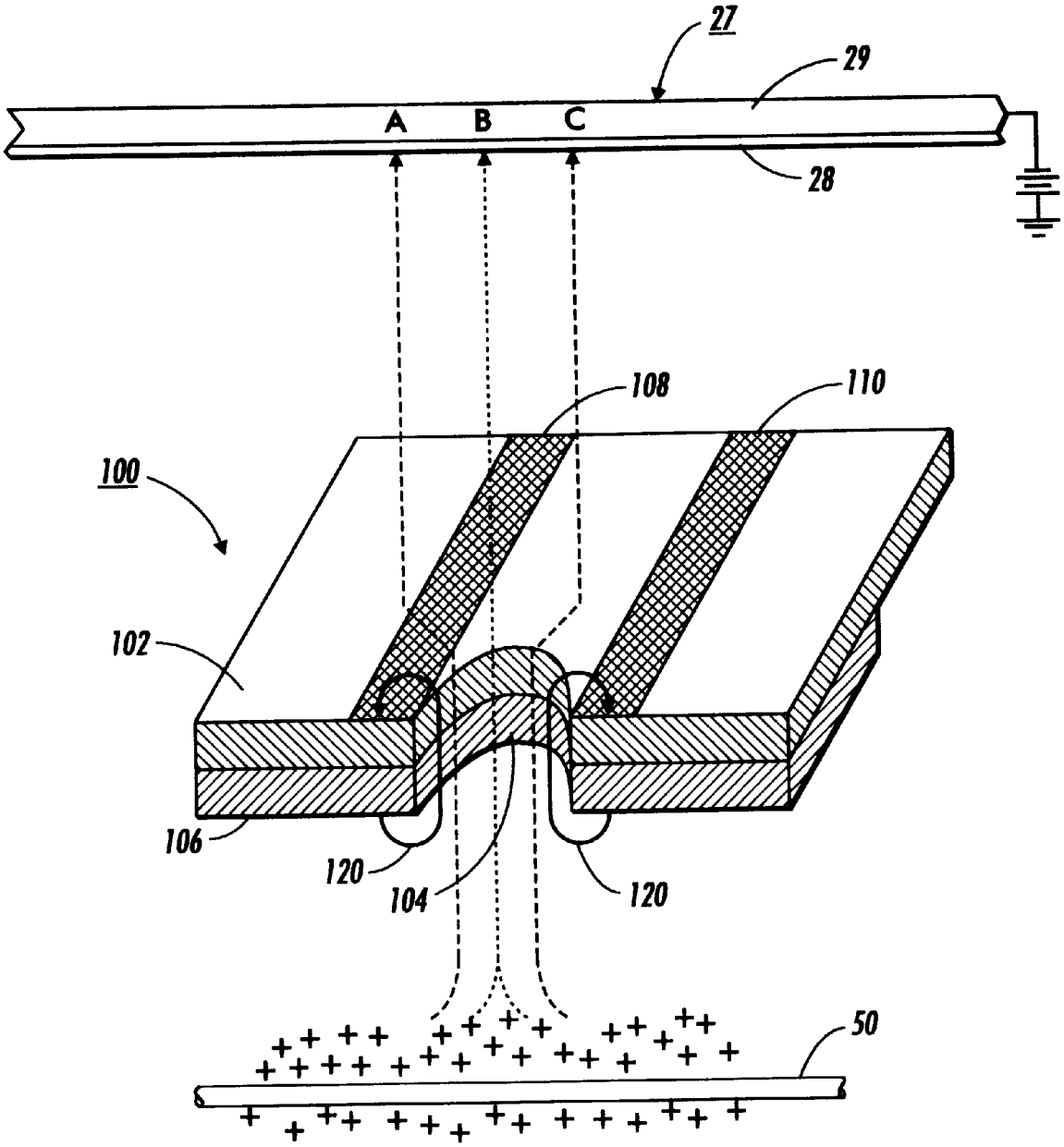
FIG. 1 is a sectional elevational view of an ion stream control device as used in ionographic printing.

FIG. 1 is a sectional elevational view through one opening in an ion stream control device 100, showing the passage of positive ions, indicated as + symbols, from a source 50 through the opening to a surface 28; surface 28 can be of a charge receptor for ionographic printing, as known in the prior art, but can also be a phosphor according to the present invention, as will be described in detail below. Although a source of positive ions is shown in the present embodiment, it will be understood that the invention could be made to work with a source of negative ions as well. Source 50 may be in the form of a corona wire extending adjacent a plurality of such openings 104 arranged in a linear or staggered linear array, or possibly the source 50 may be in the form of electrically biased pin points centered adjacent each individual aperture 104. Device 100 comprises an insulative substrate 102 having an aperture 104 defined therein for the passage of ions therethrough. On the side of the substrate 102 facing the source 50 and, in this embodiment, substantially surrounding the entire edge of aperture 104 is what shall be referred to herein as "pinch" electrode 106. On the side of substrate 102 facing surface 28 are a first displacing electrode, indicated as 108, and a second displacing electrode, indicated as 110. As shown in FIG. 1, the displacing electrodes 108 and 110 are placed on the side of the substrate 102 facing surface 28 and configured such that the displacing electrodes 108 and 110 are disposed on opposite sides along the edge of aperture 104, and therefore electrically separated.

In operation, ions are caused to pass from the source 50 through control device 100 to surface 28 in the following manner. Leaving aside for the time being considerations of placements of ions on a specific area of the surface 28, the ions from source 50 are caused to move in the desired manner due to the potential difference between the source 50 and focusing electrode 106. This creates a "potential well" to drive the ions in the control device 100. The focusing electrode 106, the displacing electrodes 108 and 110, and the surface 28 are respectively biased from high to low potentials, or specifically from more positive to less positive voltages, in that order. For example, typical values of DC bias for the respective elements would be as follows: the corona wire in source 50, +5000 volts; the focusing electrode 106, +1300 volts; displacing electrodes 108 and 110, +100 volts each; and surface 28 of surface 28, 0 volts. In general, the relative values of these biases are more important than their absolute values; the zero point in this descending order of DC biases is not important as long as the descending order is maintained. It is possible that surface 28, for example, may have a very small positive bias, zero bias, or a negative bias, as long as a potential well effect is maintained. As the ions emitted from source 50 are of a positive charge, a negative bias on the surface 28 of surface 28 will advance the passage of ions thereto.

When the focusing electrode 106 and the displacing electrodes 108 and 110 are biased to form a potential well, these electrodes create "pumping" electric fields on either side of aperture 104, the fields being generally in the direction of an ion stream passing from source 50 through aperture 104 to surface 28. One specific function of the focusing electrode 106 is to control the width of the ion stream passing through the aperture 104; generally speaking, the specific bias on focusing electrode 106 determines the cross-sectional width of an ion stream passing through aperture 104. These pumping fields, such as that shown by arrows 120, have the effect of "catching" the ion stream from source 50 (the ions being naturally attracted to progressively lower potentials) and, in effect, focusing or acting as a funnel to draw and push the ion stream through aperture 104. As focusing electrode 106 is biased more positively relative to either of the displacing electrodes 108 or 110 on the other side of substrate 102, the pumping fields are caused to loop through the aperture 104 from focusing electrode 106 to either of the displacing electrodes 108 or 110. The strength of these fields 120 serve to control the width of the ion stream through aperture 104. The bias on focusing electrode 106 therefore serves to collect and "pinch," or narrow, the width of the ion stream. The width of the resulting stream can be made significantly smaller (e.g., one-third to one-tenth the diameter, or even smaller) than the aperture 104 itself. This pinching of the ion stream can be exploited to increase the resolution of an electrostatic latent image on surface 28, as will be described in detail below.

While the focusing electrode 106 is used to control the width of the ion stream, displacement electrodes 108 and 110 are used to displace the position of the ion stream within the aperture 104, and therefore to "aim" the pinched ion stream to a specific desired area on the surface 28. Because, by virtue of the focusing electrode 106, the width of the ion stream can be made small relative to the width of the aperture 104, the ion stream may have a resolution which is much smaller than the size of the aperture 104. In the case where there is no lateral displacement of the ion stream through aperture 104, the ions from source 50 will pass straight through aperture 104 and "land" on surface 28 at the point marked B. Displacement of the ion stream to a precise area on the surface 28, such as the areas marked A or C on surface 28, is accomplished by adjusting the relative biases of first displacing electrode 108 and second displacing electrode 110.

Figure 2:
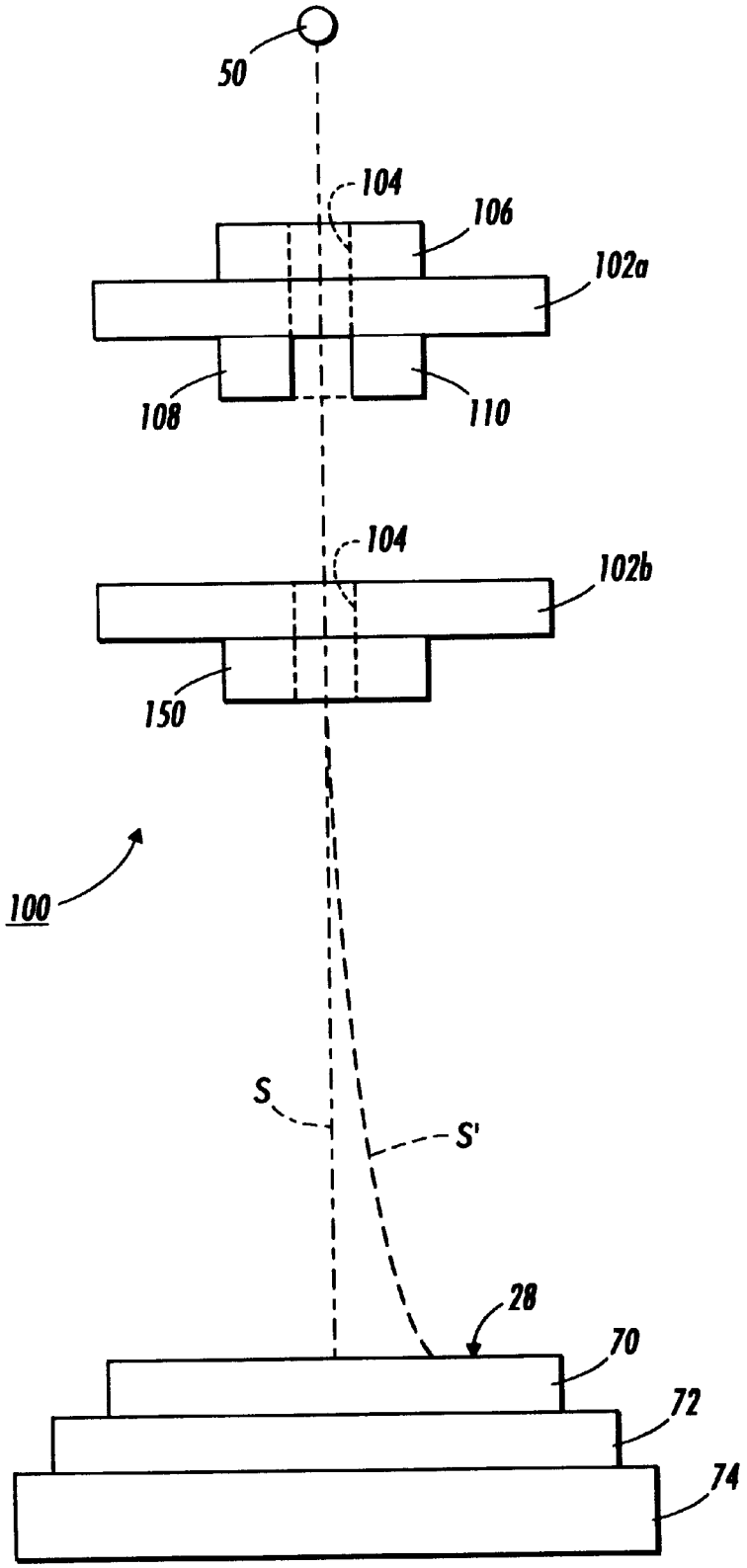
FIG. 2 is a sectional elevational view of an ion stream control device as used with a phosphor, as in the present invention.

FIG. 2 is a sectional elevational view of a single ion control device 100 according to the present invention. As with the prior-art example of FIG. 1, an ion stream from an ion source 50 is caused to pass through an aperture 104 formed in a substrate 102 (as will be described in detail below, in the preferred embodiment of the present invention, the basic substrate 102 is preferably divided into two separate substrates, here called 102*a* and 102*b*). Around the aperture 104 is the pumping electrode 106, which, by virtue of a selectable bias placed thereon, admits or prevents passage of ions from source 50 through aperture 104; and at least two displacing electrodes 108, 110, which ultimately control the displacement of the ion stream. Also included, associated with second substrate 102*b*, is a pair of pinch electrodes, one of which is shown in FIG. 2 as 150, which will be described in detail below. The biases on all of the electrodes can be ultimately controlled through a controller 200. The significant difference between the prior-art ionographic printing apparatus of FIG. 1 and the present invention as shown in FIG. 2 is that, with the present invention, the ion stream from source 50 and selectably passing through aperture 104 is directed toward a surface 28 formed on a phosphor 70.

Phosphor 70 is of a material and design generally familiar such as in the art of television. In brief, when a narrow stream of ions from a particular ion source such as 50 intersects with the surface 28 of phosphor 70, the relatively small area on the surface 28 corresponding to the cross-section of ion stream from source 50 causes the small area on the phosphor 70 to give off light. In a preferred embodiment of the present invention, the phosphor 70 is attached to a transparent conductor 72 and a transparent face plate 74, through which the resulting light may be observed as part of an image. As described above with regard to a charge receptor in the example of FIG. 1, in a preferred embodiment of the present invention, the ultimate "destination" of the ion stream, phosphor 70, is preferably at a zero bias, though what is most important is that the potential well is maintained from source 50 to phosphor 70, and therefore the bias on phosphor 70 need not be zero. In the preferred embodiment, however, where the bias on phosphor 70 is zero, the phosphor 70 can be grounded via transparent conductor 72, or else biased through transparent conductor 72. One suitable material for transparent conductor 72 is tin oxide.

In operation, for a single device such as 100 a repeating step voltage can be applied to displacement electrodes 108 and 110, thus causing the ion stream from source 50 to in effect oscillate across a small area on surface 28. While the ion stream oscillates across surface 28, a selectable bias, ultimately related to imagewise data, can be applied to pumping electrode 106, which in effect can modulate write-white and write-black (and in-between brightnesses) areas on the surface 28 of phosphor 70, according to image data. As is well known in television, the light emission from phosphor 70 will continue for a short period of time after the ion stream is no longer impinging on a particular small area, and the overall effect (which can be obtained with a high speed of oscillation of the ion stream) is to create a small portion of an image which is perceptible by either reflection or transmission on phosphor 70.

An ion stream such as shown as S, can be caused to be displaced so that the stream "hits" the surface 28 of phosphor 70 at a point beyond the borders of a particular aperture 104, such as shown as stream S' in FIG. 2. This capability is significant, because, as will be explained below, when a plurality of devices 100 are combined to create a composite image on phosphor 70, individual apertures 104 can be spaced a reasonable distance apart and still create a reasonably continuous single image on phosphor 70.

In a preferred embodiment of the present invention, a typical distance from a point charge source 50 to the surface 28 of phosphor 70 is approximately one-half inch. The substrate such as 102*a* and 102*b* are spaced as needed at different locations between the charge source 50 and phosphor 70. Significantly, the space between charge source 50 and phosphor 70 can, but need not be, evacuated for the device to operate, although of course in some situations having an evacuated space may be desirable, such as when an electron emitter is used as the charge source. Another alternative is to have the space filled with an inert gas.

Figure 3:
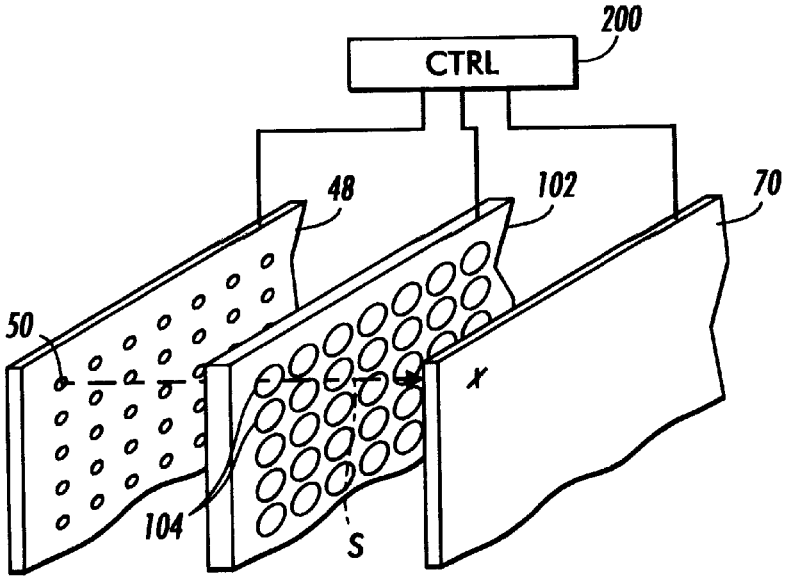
FIG. 3 is a simplified perspective view showing an embodiment of the present invention having an array of apertures for the selective passage of ion streams therethrough.

FIG. 3 is a simplified perspective view showing a preferred embodiment of the present invention, wherein there is provided, in a single substrate 102, a plurality of apertures 104 arranged in a two-dimensional array. Each aperture 104 is provided with pumping and deflecting electrodes such as shown in FIG. 2, but which are left out of FIG. 3 for clarity. There is further provided a substrate 48, having defined therein an array of exposed conductors, each exposed conductor forming a point source of charge 50 such as shown in FIG. 2. As can be seen, each point source 50 in substrate 48 is aligned with one aperture 104 in substrate 102. Thus, an ion stream originating from a single point source 50 can pass through the aperture 104 aligned therewith and selectably create a spot of light at a predetermined spot within a small area on phosphor 70. In a preferred embodiment of the invention, each individual aperture 104 in substrate 102 is provided with essentially independently-controllable pinch electrodes 106, although, as will be described below, multiple apertures 104 can conceivably share displacing electrodes such as 108, 110. Once again, because individual streams such as S can be displaced beyond the boundaries of a particular aperture 104 on the surface of a phosphor 70, a fairly liberal amount of space can be made in substrate 102 between adjacent apertures 104, and this space between apertures 104 can be used for placing of control lines to individual pinch electrodes 106: the fact that an ion stream can be deflected beyond the boundaries of a particular aperture 104 means that a substantially continuous single image can be created on the phosphor 70.

Figure 4:
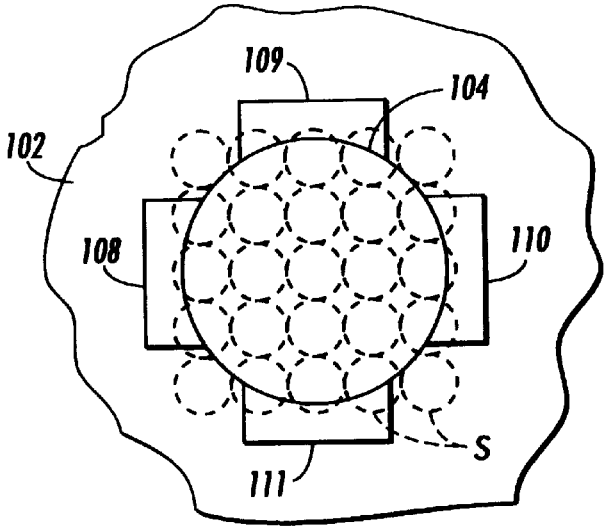
FIG. 4 is a plan view showing the principle of two-dimensional scanning of an ion stream using two sets of displacing electrodes, as in one embodiment of the present invention.

FIG. 4 is a plan view showing a preferred arrangement of deflecting electrodes 108, 109, 110, 111 around a single aperture 104. By manipulating the relative biases on oppositely-faced pairs of deflection electrodes such as 108 and 110, and 109 and 111, the location of an ion stream displaced by the electrodes can be controlled in two dimensions, as shown by the array of possible locations of an ion stream shown in FIG. 4 by the array of ion stream cross-sections S shown in phantom. Details about this operation of controlling in two dimensions, with regard to ionographic printing but similarly applicable to the present invention, are given in U.S. Pat. No. 5,617,129 incorporated by reference above. By controlling the location of the ion stream in two dimensions, each aperture 104 can in effect "cover" an essentially square-shaped small area (but possibly larger than the boundaries of aperture 104 itself on phosphor 70. By placing the square areas together, a composite single image can be created by a two-dimensional array of apertures 104. It will further be noted that the pairs of deflection electrodes 108, 110 and 109, 111 can be placed either all on the same side of a substrate such as 102*a* in FIG. 2, or different pairs can be placed on opposite sides of a substrate.

In operation, an array of ion deposition control devices can work as follows. As long as the desirable potential well from an ion source 50 down to the phosphor 70 is maintained, ions emitted from a particular source 50 on substrate 48 will pass through the aperture 104 aligned therewith and hit a particular small location on the surface of phosphor 70, causing light to be emitted from that particular small area. Of course, any recognizable image will include (at least in a monochrome example) areas of light and dark arranged in an image on the phosphor 70. In order to obtain the desired dark areas at predetermined imagewise locations on phosphor 70, particular ion streams from the various ion sources 50 will have to be momentarily blocked at a point in time where the ion stream would otherwise hit a particular small area on phosphor 70, so that, for as long as a particular image is desired to be displayed, no ions will hit the particular small area 70.

With regard to the charge sources 50, a suitable design of a charging device is described in U.S. Pat. No. 4,963,738, assigned to the assignee hereof. As described in this patent, the individual charge source 50 comprises a ruthenium glass electrode which is silk screened onto a supporting dielectric substrate. The structure as described in the patent has been found to be useful for creation of small charge point sources which can be closely spaced with a minimum of field interference from adjacent charge sources.

In order to momentarily block, or in other words modulate, the ion streams from the various sources 50, the simplest technique is to momentarily disrupt the potential well between a particular ion source 50 and the phosphor 70. Recall above that this potential well is created by providing a sequence of biases on the various electrodes on a path from a source 50 to phosphor 70 from (using a positive-ion example) a high positive bias on the source 50 to a zero bias on the phosphor 70; the intermediate electrodes between the source 50 and phosphor 70, such as focusing electrode 106 and displacing electrodes 108 and 110, become progressively less positive in bias depending on their location relative to phosphor 70. To momentarily disrupt this potential well, any particular bias from source 50 to phosphor 70 can be momentarily changed: for example, a particular ion source 50 in substrate 48 can be momentarily shut off or even simply slightly lowered in voltage; the focusing electrode 106 associated with a particular aperture 104 could receive an increase in voltage, thus blocking ions from the source 50 from the aperture 104; or one or both displacing electrodes 108, 110 could similarly be momentarily increased in bias. The selection of how exactly to modulate an ion stream passing through a particular aperture 104 will depend on other design considerations, such as whether all of the apertures 104 share a common focusing electrode 106, or if it is decided that each individual aperture 104 will have an independently-addressable focusing electrode 106. In general, however, it is probably most convenient to have multiple apertures 104 in a particular row share a common pair of displacing electrodes 108, 110 (such as shown, for example, in the patents incorporated by reference above) so that all of the apertures in a particular row (or indeed all of the apertures in the entire substrate 102) are displacing the ion streams passing therethrough to the same extent at all times. Coordination of the displacement of particular ion streams through all apertures 104 is coordinated by a control system 200, which can also control the bias on phosphor 70 or modulation of various ion streams from sources 50, depending on imagewise data.

Whatever system is used to modulate the ion streams in accordance with imagewise data, the display apparatus of the present invention can be controlled by image data in the form of either analog television signals or digital signals. Typically, analog television signals are low-resolution, such as 525 horizontal lines for an image to be displayed on a 12-inch screen; while digital signals, such for a document that would otherwise be electronically printed, may have a resolution of 300 to 600 spots per inch for an 11-by-8.5 inch page. It is a virtue of the present invention that the same display apparatus can be used for both types of image data, and the fundamental differences in resolution can be resolved immediately upstream of the display apparatus. Further, differences in the image resolution of data can, in a rough sense, be adapted for by adjusting the bias on various electrodes, particularly focusing electrode 106: it is conceivable that the cross-sectional area of an ion stream S can be made fairly wide (such as, as wide as an aperture 104), with little or no displacement from displacing electrodes 108, 110, so that low-resolution images can be displayed; or the same electrodes in the same display apparatus can be so biased to produce a very narrow ion stream which is displaceable through a large number of pixel locations, so that high-resolution images can be displayed.

Preferred materials for forming the insulating portions of any insulating layers such as 102*a* or 102*b* include PC board, alumina, or plastic film. The different insulative substrates such as 102*a* and 102*b* can be spaced any distance apart depending on the specific design of an apparatus, from 1 mil to several inches; and of course the overall thickness of the entire apparatus from face plate to array of charge sources can be several inches. Suitable materials for the face plate 74 include glass, vinyl film, or transparent plastics. The various layers in a display such as in FIG. 4 can be spaced apart, or directly stacked by solid members between the various insulative substrates to ensure proper spacing. The display apparatus can be provided with a flat battery, such as is generally familiar in instant photography film packs, to act as a power source. The apparatus of the present invention can operate entirely within a normal atmosphere, particularly if the charge generators 50 are intended to emit positive ions. For small-scale displays, however, it is probably preferable to have the charge sources 50 emit electrons, and have the space between the charge sources 50 and the phosphor 70 evacuated.

A practical consideration for ionographic printing with a focused ion stream is the "bow tie" effect of deflected ion streams. Ion streams which are deflected minimally by the displacing electrodes 108 and 110, and which therefore pass through the aperture 104 toward the center thereof, tend to be reasonably round in cross-section. However, when the displacing electrodes 108 or 110 are used to displace this ion stream toward one edge or another of the aperture 104, the cross-sectional shape of the deflected ion stream tends to flatten out and become not round but elongated-oval. Because of the oval shape of the cross-section of the ion stream passing through aperture 104, the resulting spot of charged area on the surface 28 will be flattened oval area, and as a result, the various spots of illuminated area on phosphor 70 will vary in shape and size.

Figure 5:
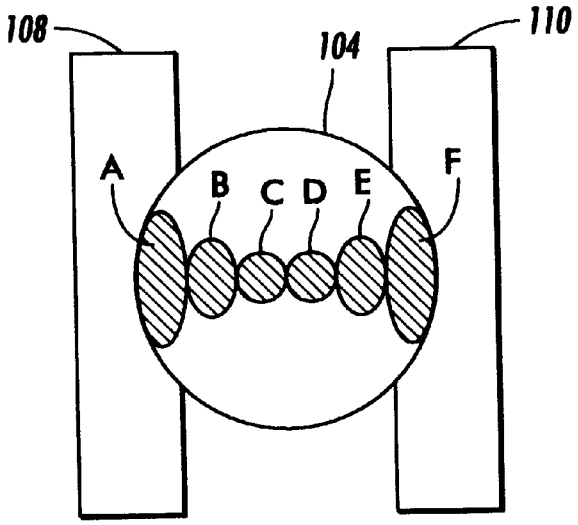
FIG. 5 PRIOR ART
FIG. 5 is a plan view through a single aperture in an ionographic display, showing the anomaly of ion stream cross-section distortion.

FIG. 5 is a plan view through an aperture 104 showing a typical behavior of an ion stream at various extents of displacement, shown in cross-section as A–F. The spots related to more displaced ion streams, such as spot A near electrode 108 or spot F near electrode 110, do not exhibit the desirable round shape of the spots such as C and D toward the center of the aperture 104.

Figure 6:
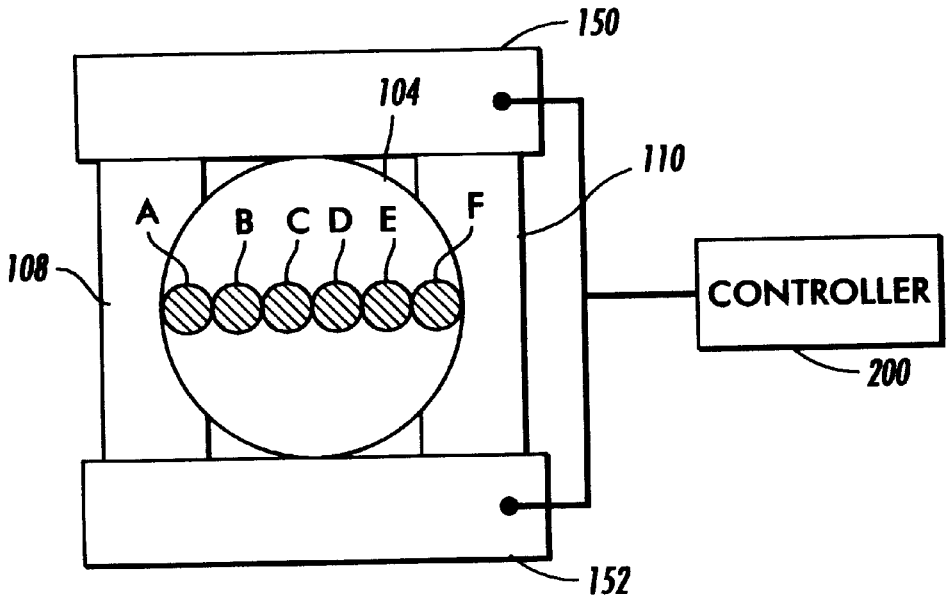
FIG. 6 is a perspective view of a single aperture, with associated electrodes, of an ionographic display according to the present invention.

FIG. 6 is a perspective view of a single aperture 104, with accompanying electrodes, of an ionographic array (or ion deposition control apparatus) according to a preferred embodiment of the present invention. As can be seen in FIG. 6, the aperture 104 defined in substrate 102 includes, in addition to the focusing electrode 106 and displacing electrodes 108 and 110, a pair of what are here called "pinch" electrodes 150 and 152. The pinch electrodes 150 and 152 are spaced from the displacing electrodes 108 and 110 by insulating substrates 154 and 156 respectively. If the path through an aperture 104 is considered the "length" of the aperture, and the displacing electrodes 108 and 110 are considered as disposed at one location along this length, the pinch electrodes 150 and 152 are disposed at a second location along the length of the aperture 104. Also, while the displacing electrodes 108 and 110 are disposed across the aperture 104 from each other across one axis through aperture 104, the pinch electrodes 150 and 152 are disposed across the aperture 104 from each other across a second axis through aperture 104, the second axis being substantially perpendicular to the first axis. The pinch electrodes 150 and 152 are electrically isolated from the displacing electrode 108 and 110.

The purpose of displacing electrodes 108 and 110 is to deflect the ion stream passing through aperture 104 along a first displacement path, that displacement path being generally perpendicular to the process direction shown as P in the Figure, such as that corresponding to the relative positions of spots A–F in FIG. 5. In contrast, the pinch electrodes 150 and 152 can be biased to counteract the bow-tie effect illustrated in FIG. 5. FIG. 6 shows how the distortion of the cross-section of the displaced ion stream toward the edges of the aperture 104 can be counteracted by the application of an equal bias to both focus electrodes. This equal bias to both pinch electrodes 150 and 152 is supplied by a control means 200 which is adapted to vary the bias to the pinch electrodes 150 and 152 as a function of the relative bias between displacing electrodes 108 and 110. Increasing bias applied equally to both pinch electrodes 150 and 152 can exert a force to "squeeze" the ion stream in a direction perpendicular to the displacement path formed by displacing electrodes 108 and 110, counteracting the distortion in the cross-section. This counteracting of the distortion can be seen by comparing the shapes of the spots A, B, E, and F in FIG. 5 and FIG. 6 respectively.

The need for the "squeezing" effect of the pinch electrodes 150, 152 requires more absolute voltage as the ion stream deflection caused by displacing electrodes 108 and 110 is increased such as in spots A and F. Spots C and D, which are close to the center of aperture 104, require essentially no correction by the pinch electrodes 150, 152 at all. By use of this apparatus and technique, every spot of charged area placed on the surface 28 of phosphor 27 will have generally the same desirable round shape, regardless of the extent of displacement of the ion stream by displacing electrodes 108 and 110.

Returning to FIG. 2, it can be seen that the pinch electrodes 150, 152 are preferably placed on a substrate 102*b* which is distinct form the substrate 102*a* on which the focusing electrode 106 and displacing electrodes 108, 110 are mounted; however it is possible to provide the various types of electrodes on any number of substrates for particular purposes. For instance, if overall "flatness" of the display apparatus is important, it will be preferred to use a small number of substrates 102; if flatness is overall less of a concern than precise spot shape or maximizing the number of locations on the phosphor that can be addressed per aperture 104, placing the various electrodes on two or more substrates 102 will be desirable.

Returning to FIG. 4, it can further be seen that in a case where there are provided two pairs of displacing electrodes 108, 110 and 109, 111 for two-dimensional displacement of an ion stream, there can be provided a comparable two-dimensional arrangement of pinch electrodes such as 150, 152, to eliminate the "bow-tie" effect for ion streams which are displaced in either dimension. A second pair of pinch electrodes 150, 152 (not shown), arranged perpendicular to the first pair of displacing electrodes around an aperture 104, can be used to cure spot-shape anomalies as needed for a displaced ion stream. Once again, this second pair of pinch electrodes can be disposed on the same side or different side of a substrate such as 102*b* as the first pair of pinch electrodes, or, alternately, a pair of pinch electrodes 150, 152 can share a substrate 102*a* with displacing electrodes 108, 110 for displacing an ion stream in one dimension, and another pair of pinch electrodes 150, 152 can share a substrate 102*b* with displacing electrodes 108, 110 for displacing an ion stream in the other dimension.

FIG. 7 is a plan view showing a preferred embodiment of electrodes on one surface of a particular substrate 102. The apertures 104, which in this embodiment are each square-shaped, are formed in a square array, and the displacing electrodes 108, 110 (shown in cross-hatching in the Figure) are arranged with the columns of apertures 104 so that a particular pinch electrode 110 will be disposed on one side of one column of apertures 104 and disposed on the opposite side of a neighboring column of apertures 104. In effect, each column of apertures 104 shares a displacing electrode with the neighboring columns of apertures on either side. If all of the displacing electrodes 108 are commonly controlled and all of the displacing electrodes 110 are commonly controlled as well, it will be apparent that an increase in bias on, for example, the displacing electrodes 110 will cause deflection of ion streams in opposite directions for the two columns of apertures 104 on either side of the particular displacing electrode 110. This configuration need simply to be taken into account when processing imagewise data in accordance with the deflection at any given time, but also makes for simpler arrangement of electrodes on a particular surface of a substrate 102. The same principle of having adjacent rows or columns of apertures share a particular electrode can be applied to pinch electrodes 150, 152 as well.

It will further be noticed in FIG. 7 that, in this particular embodiment, the apertures 104 are of square shape; the specific shape of individual apertures 104 can be used to affect the behavior of the displacing electrodes in creating a small "cell" of pixel areas accessible by a single aperture 104. While it is possible that a round aperture 104 can write to a square cell, a square aperture 104 may, given specific parameters of an apparatus, create a square cell of pixel areas with greater evenness, efficiency, or more desirable spot size.

In the various embodiments of the present invention having an array of individual ion stream-controlling apertures 104, it is a matter of design choice as to how much pixel overlap adjacent apertures should have. It may be desirable to have adjacent apertures able to displace ion streams so that at least one row of pixels on the phosphors 70 can be accessed by the ion streams from either aperture. Arrangements of how such pixels from adjacent apertures may overlap will depend on numerous factors, in particular, the general shape of the apertures 104: for example, if the apertures are round, the geometry of the ranges of pixel placement or ion stream displacement of each aperture may be taken into account, and these factors may be different in the case of a square shaped aperture.

The display apparatus according to the present invention can readily be adapted for the display of full-color images. Special phosphors for displaying three primary colors to form a coherent image are well known in the art of color television. In one basic type of color phosphor used in color television, different small portions of a phosphor surface are adapted to emit light of different primary colors when electrons from an electron gun hit the small area of the phosphor. These small areas of phosphor are arranged close together, such as in stripes or small spots, so that when signals are applied to different-colored small areas on the phosphor, the different luminances from each primary-colored phosphor area will blend together to form a coherent color image when the phosphor is viewed from a distance.

FIG. 8 is a simplified view showing the essential elements of a color embodiment of the display apparatus of the present invention. Shown in FIG. 8 is a portion of a substrate 102 having two apertures 104 defined therein, the apertures 104 each being associated with any number of electrodes adjacent thereto, as described in detail above. The apertures 104 shown in FIG. 8 represent only two of what is preferably a large array of apertures typically of the range of 1/16 inch each in diameter, arranged to form a display of, for example, three to ten inches across. As can be seen in FIG. 8, each aperture 104 in substrate 102 controls an ion stream S. By applying selected biases to the various electrodes associated with the apertures 104, each ion stream S can be aimed to a selected small area on the phosphor, which in the FIG. 8 embodiment is indicated as a special color-capable phosphor 70'. In the particular embodiment shown in FIG. 8, each aperture 104 is capable of displacing the ion stream S passing therethrough to any one of 36 positions forming a six-pixel by six-pixel array.

In FIG. 8, it can be seen that the phosphor 70' is subdivided into distinct stripes, each stripe being associated with one primary color, red (R), green (G), and blue (B), arranged in a repetitive pattern as shown. It will further be seen that the placement of spots available for displacing the ion stream S for each aperture 104 corresponds to individual stripes in phosphor 70'. Thus, in this embodiment, a single aperture 104 can create a portion of an image across two RGB sets of phosphors in a six-pixel by six-pixel square. By modulating the stream S as it is displaced to one or another primary color phosphor stripe, a small portion or "cell" of a larger color image can be created depending on which particular primary color phosphor stripes are illuminated at a time. The total light output from a large series of ion streams hitting the various colors of the phosphor 70' is integrated by the eye to produce the desired color sensation, just in the manner of color television.

Of course, the image data used to create such an image must be coordinated so that, for example, when a series of ion streams S are at a particular point in time "aimed at" red stripes, the red-based primary color signals are causing the modulation of the image data among an array of apertures 104. Immediately after being aimed at the red stripe, for example, as the ion streams from the apertures 104 are displaced to a green stripe on the phosphor, the green primary-color separation data must be used to modulate the ion streams.

With regard to the specific structure of a phosphor 70', in one possible embodiment, the individual primary-color stripes are approximately 10 mils wide, with a metal opaque region of 2 mils in width separating the stripes. Since the viewer will be at a distance from the phosphor 70', resolution of the separation metal (or the mask) is not resolvable by the eye. It is also possible, if desired, to employ UV or IR emitting phosphor stripes in phosphor 70'.

One particular advantage of the display apparatus of the present invention, which has an array of individual ion sources, over a standard cathode ray tube, which typically has in effect a single electron gun for an entire screen, is that extremely high time resolutions of moving images can be created on the display apparatus of the present invention. Whereas in a standard CRT, a single electron beam must scan the entire 525 lines of a screen (i.e., an entire image) before the next "frame" of image data can be displayed, each individual aperture 104 of the present invention can create its own small portion of the image simultaneously, so that a frame of moving image data can be processed in only the time required for each aperture 104 to create its own cell of the image. Thus, images on the phosphor 70 can be changed very quickly.

The display apparatus of the present invention has particular applicability to very large display systems, such as stadium scoreboards or theater presentations. Arrays of very large apertures 104 can be constructed, and, since at least the positive-ion version of the present invention can readily operate in air, a very large screen would not have to be evacuated between the phosphor 70 and the array of charge generators 50.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An electronic display apparatus, comprising:

an ion source;

a phosphor;

a first substrate, disposed between and spaced from the ion source and the phosphor, defining an aperture for passage of ions therethrough;

a focusing electrode, disposed on the substrate, including a conductive surface facing the ion source;

a first displacing electrode associated with the substrate, for displacing an ion stream passing through the aperture through a first displacement path;

first and second pinch electrodes associated with the aperture, for exerting a force to squeeze the ion stream in a direction perpendicular to the displacement path; and a second substrate disposed between the ion source and the phosphor, the second substrate defining an aperture therein which is aligned with the aperture in the first substrate;

wherein at least one of the displacing electrode or the pinch electrodes are disposed on the second substrate.

2. The apparatus of claim 1, further comprising control means for applying a selected potential to the first displacing electrode so that the displacing electrode displaces an ion stream passing through the aperture to a selectable extent through the first displacement path.

3. The apparatus of claim 1, further comprising control means for applying a selected potential equally to the first and second pinch electrodes, the potential being a function of a selected extent of displacement of the ion stream through the first displacement path.

4. The apparatus of claim 1, further comprising a second displacing electrode associated with the aperture, for displacing an ion stream passing through the aperture through a second displacement path.

5. The apparatus of claim 1, further comprising means for biasing the phosphor.

6. The apparatus of claim 5, the means for biasing the phosphor including means for grounding the phosphor.

7. The apparatus of claim 1, the phosphor defining a first small area which causes emission of light of a first color when an ion stream contacts the small area, and a second small area which causes emission of light of a second color when an ion stream contacts the small area.

8. The apparatus of claim 7, wherein the first small area is located to receive an ion stream when the ion stream is at a first position along the first displacement path, and the second small area is located to receive an ion stream when the ion stream is at a second position along the first displacement path.

9. The apparatus of claim 1, wherein a space between the ion source and the phosphor is evacuated.

10. The apparatus of claim 1, wherein a space between the ion source and the phosphor is not evacuated.

11. The apparatus of claim 1, wherein a space between the ion source and the phosphor substantially contains inert gas.

12. An electronic display apparatus, comprising:

an ion source;

a phosphor;

a first substrate, disposed between and spaced from the ion source and the phosphor, defining an array of apertures for passage of ions therethrough;

a focusing electrode, disposed on the substrate, including a conductive surface facing the ion source;

a first displacing electrode associated with each aperture, for displacing an ion stream passing through the aperture through a first displacement path first and second pinch electrodes associated with each aperture, for exerting a force to squeeze the ion stream in a direction perpendicular to the displacement path; and a second substrate disposed between the ion source and the phosphor, the second substrate defining an array of apertures therein which is aligned with the apertures in the first substrate;

wherein at least one of the displacing electrode or the pinch electrodes associated with each aperture are disposed on the second substrate.

13. The apparatus of claim 12, the ion source including a plurality of ion sources, each ion source in the array being aligned with an aperture in the substrate.

14. The apparatus of claim 12, further comprising control means for applying a selected potential to the first displacing electrode associated with each aperture so that the displacing electrode displaces an ion stream passing through the aperture to a selectable extent through the first displacement path.

15. The apparatus of claim 12, further comprising control means for applying a selected potential equally to the first and second pinch electrodes, the potential being a function of a selected extent of displacement of the ion stream through the first displacement path.

16. The apparatus of claim 12, further comprising a second displacing electrode associated with each aperture, for displacing an ion stream passing through the aperture through a second displacement path.

17. The apparatus of claim 12, further comprising means for biasing the phosphor.

18. The apparatus of claim 17, the means for biasing the phosphor including means for grounding the phosphor.

19. The apparatus of claim 12, the phosphor defining a first small area which causes emission of light of a first color when an ion stream contacts the small area, and a second small area which causes emission of light of a second color when an ion stream contacts the small area.

20. The apparatus of claim 19, wherein the first small area is located to receive an ion stream when the ion stream is at a first position along the first displacement path, and the second small area is located to receive an ion stream when the ion stream is at a second position along the first displacement path.

21. The apparatus of claim 12, wherein a space between the ion source and the phosphor is evacuated.

22. The apparatus of claim 12, wherein a space between the ion source and the phosphor is not evacuated.

23. The apparatus of claim 12, wherein a space between the ion source and the phosphor substantially contains inert gas.

24. An electronic display apparatus, comprising:

a plurality of ion sources, arranged in an array;

a phosphor;

a first substrate, disposed between and spaced from the ion source and the phosphor, defining an array of apertures, each aperture in the substrate aligned with an ion source for passage of ions therethrough;

a focusing electrode associated with each aperture, each focusing electrode including a conductive surface facing the ion source;

first and second pinch electrodes associated with each aperture, for exerting a force to squeeze the ion stream in a direction perpendicular to the displacement path; and a second substrate disposed between the ion source and the phosphor, the second substrate defining an array of apertures therein which is aligned with the apertures in the first substrate;

wherein at least one of the displacing electrode or the pinch electrodes associated with each aperture are disposed on the second substrate.

25. The apparatus of claim 24, further comprising control means for applying a selected potential to the focusing electrode associated with each aperture, thereby controlling a cross-sectional area of an ion stream passing through the aperture.

26. The apparatus of claim 24, further comprising a first displacing electrode associated with each aperture, for displacing an ion stream passing through the aperture through a first displacement path.

27. The apparatus of claim 26, further comprising control means for applying a selected potential to the first displacing electrode associated with each aperture so that the displacing electrode displaces an ion stream passing through the aperture to a selectable extent through the first displacement path.

28. The apparatus of claim 24, further comprising control means for applying a selected potential equally to the first and second pinch electrodes, the potential being a function of a selected extent of displacement of the ion stream through the first displacement path.

29. The apparatus of claim 24, further comprising a second displacing electrode associated with each aperture, for displacing an ion stream passing through the aperture through a second displacement path.

30. The apparatus of claim 24, further comprising means for biasing the phosphor.

31. The apparatus of claim 30, the means for biasing the phosphor including means for grounding the phosphor.

32. The apparatus of claim 24, the phosphor defining a first small area which causes emission of light of a first color when an ion stream contacts the small area, and a second small area which causes emission of light of a second color when an ion stream contacts the small area.

33. The apparatus of claim 32, wherein the first small area is located to receive an ion stream when the ion stream is at a first position along the first displacement path, and the second small area is located to receive an ion stream when the ion stream is at a second position along the first displacement path.

34. The apparatus of claim 24, wherein a space between the ion source and the phosphor is evacuated.

35. The apparatus of claim 24, wherein a space between the ion source and the phosphor is not evacuated.

36. The apparatus of claim 24, wherein a space between the ion source and the phosphor substantially contains inert gas.

37. An electronic display apparatus, comprising:

an ion source;

a phosphor;

a first substrate, disposed between and spaced from the ion source and the phosphor, defining an aperture for passage of ions therethrough;

a focusing electrode, disposed on the substrate, including a conductive surface facing the ion source;

a first displacing electrode associated with the substrate, for displacing an ion stream passing through the aperture through a first displacement path; and a second displacing electrode associated with the aperture, for displacing an ion stream passing through the aperture through a second displacement path.

38. The apparatus of claim 37, further comprising means for biasing the phosphor.

39. The apparatus of claim 38, the means for biasing the phosphor including means for grounding the phosphor.

40. The apparatus of claim 37, the phosphor defining a first small area which causes emission of light of a first color when an ion stream contacts the small area, and a second small area which causes emission of light of a second color when an ion stream contacts the small area.

41. The apparatus of claim 40, wherein the first small area is located to receive an ion stream when the ion stream is at a first position along the first displacement path, and the second small area is located to receive an ion stream when the ion stream is at a second position along the first displacement path.

42. The apparatus of claim 37, wherein a space between the ion source and the phosphor is evacuated.

43. The apparatus of claim 37, wherein a space between the ion source and the phosphor is not evacuated.

* * * * *